US008182370B1

(12) United States Patent
Neel, III

(10) Patent No.: US 8,182,370 B1
(45) Date of Patent: May 22, 2012

(54) GOLF INSTRUCTION METHOD AND APPARATUS

(75) Inventor: William B. Neel, III, San Dimas, CA (US)

(73) Assignee: Will Neel Golf Academy Inc., San Dimas, CA (US)

( * ) Notice: Subject to any disclaimer, the term of this patent is extended or adjusted under 35 U.S.C. 154(b) by 106 days.

(21) Appl. No.: 12/799,684

(22) Filed: Apr. 28, 2010

Related U.S. Application Data

(60) Provisional application No. 61/173,309, filed on Apr. 28, 2009.

(51) Int. Cl.
*A63B 69/36* (2006.01)

(52) U.S. Cl. ..... 473/409; 473/218; 473/257; 473/273

(58) Field of Classification Search ..... 473/218, 473/219, 257, 261, 262, 264, 265, 266, 270, 473/272, 273, 278, 279, 409
See application file for complete search history.

(56) References Cited

U.S. PATENT DOCUMENTS

| | | | | |
|---|---|---|---|---|
| 2,886,326 | A * | 5/1959 | Olds | 473/218 |
| 5,171,017 | A * | 12/1992 | Betancourt | 473/218 |
| 5,827,125 | A * | 10/1998 | Lee | 473/139 |
| 7,037,210 | B2 * | 5/2006 | Bainter | 473/270 |
| 7,927,228 | B2 * | 4/2011 | Rhodes | 473/270 |
| 2005/0197199 | A1 * | 9/2005 | Cardosi | 473/257 |
| 2009/0305804 | A1 * | 12/2009 | Kramski | 473/218 |

* cited by examiner

*Primary Examiner* — Nini Legesse
(74) *Attorney, Agent, or Firm* — Renner, Kenner, Greive, Bobak, Taylor & Weber

(57) ABSTRACT

A method and apparatus for providing golf instruction includes an alignment rod and an instruction flag removably secured to the alignment rod. The alignment rod may be positioned on a ground surface to indicate a target path or otherwise provide a visual cue. The instruction flag includes instructional markings thereon to provide additional visual cues relating to one or more aspects of a golf swing.

4 Claims, 7 Drawing Sheets

GOLF INSTRUCTION METHOD AND APPARATUS

This application claims priority of U.S. Provisional Application No. 61/173,309 filed Apr. 28, 2009, which is incorporated herein by reference in its entirety.

TECHNICAL FIELD

This invention relates to a method and apparatus for providing golf instruction. More specifically, this invention relates to a method of providing golf instruction using an instruction flag secured to an alignment rod.

BACKGROUND ART

Novice and experienced golfers are always seeking to develop and maintain consistency in all aspects of a golf swing. Several of the more important components of a good golf swing are the swing plane, club head alignment, and the golfer's stance and body position before and throughout the swing. Consistency in these and other aspects of a golf swing require practice and repetition.

Golf instructors are often hired by both novice and experienced golfers to identify mistakes and errors in a golfer's swing and to provide instruction on how to correct the swing. In many cases, golf instructors utilize teaching aids and instructional tools to provide visual cues to the golfer to help correct errors and develop consistency. While many of these teaching aids are at least somewhat effective, they also suffer from a number of common disadvantages.

Many teaching aids used by golf instructors are large and/or complicated and are therefore not suited for easy relocation and set-up. The difficulty associated with these devices often results in a golfer choosing not to use them when they practice at home or on their own away from the instructor. In addition, many teaching aids are designed to correct one specific mistake or to address a single aspect of the golf swing. Thus, several teaching aids may be required to address all of the errors in a golfer's swing. Again, this may lead to a golfer electing to practice without the teaching aids.

Thus, there is a need for a method and apparatus for providing golf instruction that is simple, easy to use, and adaptable to address several aspects of a golf swing.

DISCLOSURE OF THE INVENTION

It is thus an object of one aspect of the present invention to provide a method and apparatus for giving golf instruction using an alignment rod and an instruction flag.

It is an object of another aspect of the present invention to provide a method and apparatus for giving golf instruction, as above, where the alignment rod is positioned on a ground surface and the instruction flag is secured to the alignment rod.

It is an object of another aspect of the present invention to provide a method and apparatus for giving golf instruction, as above, in which the golfer is provided with visual cues to correct and improve a golf swing.

These and other objects of the present invention, as well as the advantages thereof over existing prior art forms, which will become apparent from the description to follow, are accomplished by the improvements hereinafter described and claimed.

In general, a method according to the concepts of the present invention includes the steps of providing an alignment rod, providing a flag having instructional markings thereon, securing the flag to the alignment rod, positioning the alignment rod and flag on a ground surface so that the instructional markings are facing up, and instructing a golfer using the alignment rod, flag and instructional markings.

In accordance with at least one aspect of the present invention, a method includes the steps of positioning an alignment rod on a ground surface, the alignment rod having a flag with instructional markings secured thereto, and practicing golf swing technique using the alignment rod and instructional markings.

In accordance with at least one aspect of the present invention, a golf instruction apparatus includes a flag having a first planar surface and a second planar surface, a rod clamp extending from the first planar surface adjacent an edge of the flag, the rod clamp adapted to removably attach the flag to an alignment rod, and golf instruction markings on the first planar surface.

A preferred exemplary method and apparatus for providing golf instruction according to the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
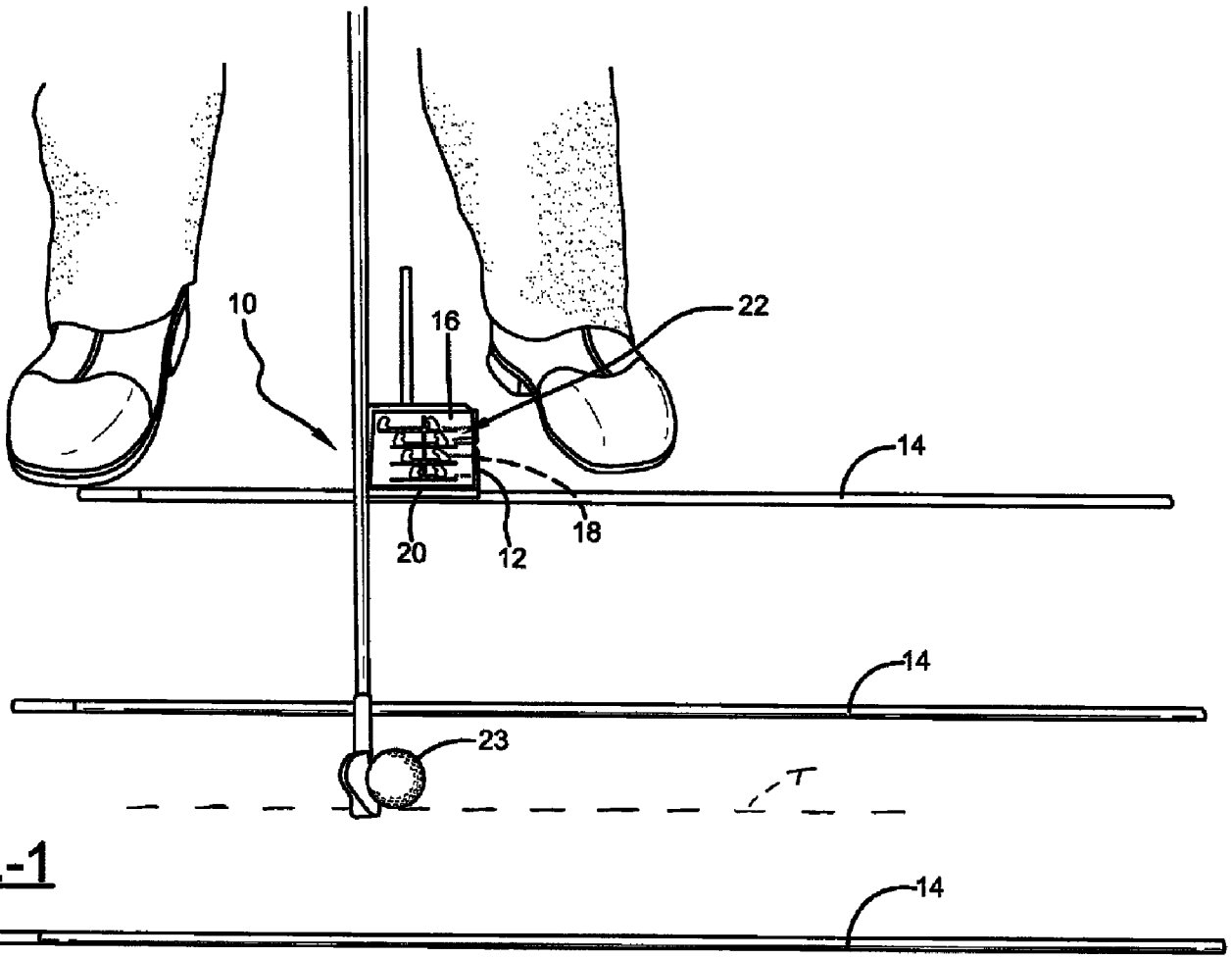
FIG. 1 is a fragmentary perspective view of a golfer using a golf instruction apparatus according to the concepts of the present invention.

A golf instruction apparatus made in accordance with the present invention is indicated generally by the numeral 10 and includes an instruction flag 12 secured to an alignment rod 14. Alignment rod 14 is known to those skilled in the art and is used in a variety of ways as a golf teaching tool. For example, as shown in FIG. 1, one or more alignment rods 14 may be positioned on a ground surface to indicate a target line T or offer visual cues for other aspects of a golf swing. Alignment rods 14 are conventionally made of fiberglass, but may be made using other suitable materials known to those skilled in the art. Alignment rods 14 may have any desired length suitable for the intended instructional use. For example, alignment rods are readily available having a length of approximately 48 inches. The diameter of alignment rods 14 is relatively small compared to the length, and may be between approximately 0.25 and 0.5 inches.

Instruction flag 12 is generally planar in shape and includes a first surface 16 and a second surface 18. Instruction flag 12 may be made of any material known to those skilled in the art, such as, for example, plastics or other composite materials. A clamping mechanism, or rod clamp, 20 extends from either first surface 16 or second surface 18 of instruction flag 12 and is adapted to secure the flag to alignment rod 14.

In the embodiments shown in the drawings, rod clamp 20 extends from instruction flag 12 along an edge thereof so that the flag is oriented generally perpendicularly to alignment rod 14. However, it is contemplated that rod clamp 20 could also be oriented along a planar surface of instruction flag 12 at an angle to achieve any desired positional relationship between instruction flag 12 and alignment rod 14. It is also contemplated that a hole may be provided through instruction flag 12 to allow a golf tee or other anchoring device to be inserted therethrough, thereby anchoring the golf instruction apparatus 10 to a ground surface.

Rod clamp 20 may use any known method or mechanism to removably secure instruction flag 12 to alignment rod 14. In the embodiments of the invention discussed herein and shown in the drawings, rod clamp 20 includes a generally C-shaped channel 21 formed in a projection 19 extending from the planar portion of instruction flag 12. The projection 19 is made of a resilient material that possesses at least a minimal degree of flexibility. The diameter of alignment rod 14 is slightly larger than an opening 21*a* in C-shaped channel 21. Alignment rod 14 is pressed into the opening 21*a* of the C-shaped channel, causing the two sides of the projection to flex outwardly as it passes therethrough. Once alignment rod 14 passes through opening 21*a*, the two sides of the projection 19 return to their original positions and act to secure alignment rod 14 within channel 21. The alignment rod may be removed from the C-shaped channel in a similar manner.

Instruction flag 12 includes markings or other visual cues 22 on either first surface 16 or second surface 18. The instructional markings may be directed to any aspect of a golf swing and, along with alignment rod 14, act to assist a golfer in consistently performing that aspect of the swing correctly. The instructional markings 22 may include words and images depicting proper form, body position or club position. Instructional markings 22 may also include cut-outs or slots in instruction flag 12 that indicate proper ball position, target lines, club face angles or other aspects of a golf swing. It is contemplated that the instructional markings 22 may relate to or provide visual cues for any aspect of a golf swing, and may be provided in any form, as will be apparent to those skilled in the art. Thus, the invention should not be limited to the instructional markings discussed herein. The removable connection of instruction flag 12 to alignment rod 14 allows various instruction flags having different markings to be utilized with the alignment rod to correct numerous aspects of a golf swing.

Figure 2:
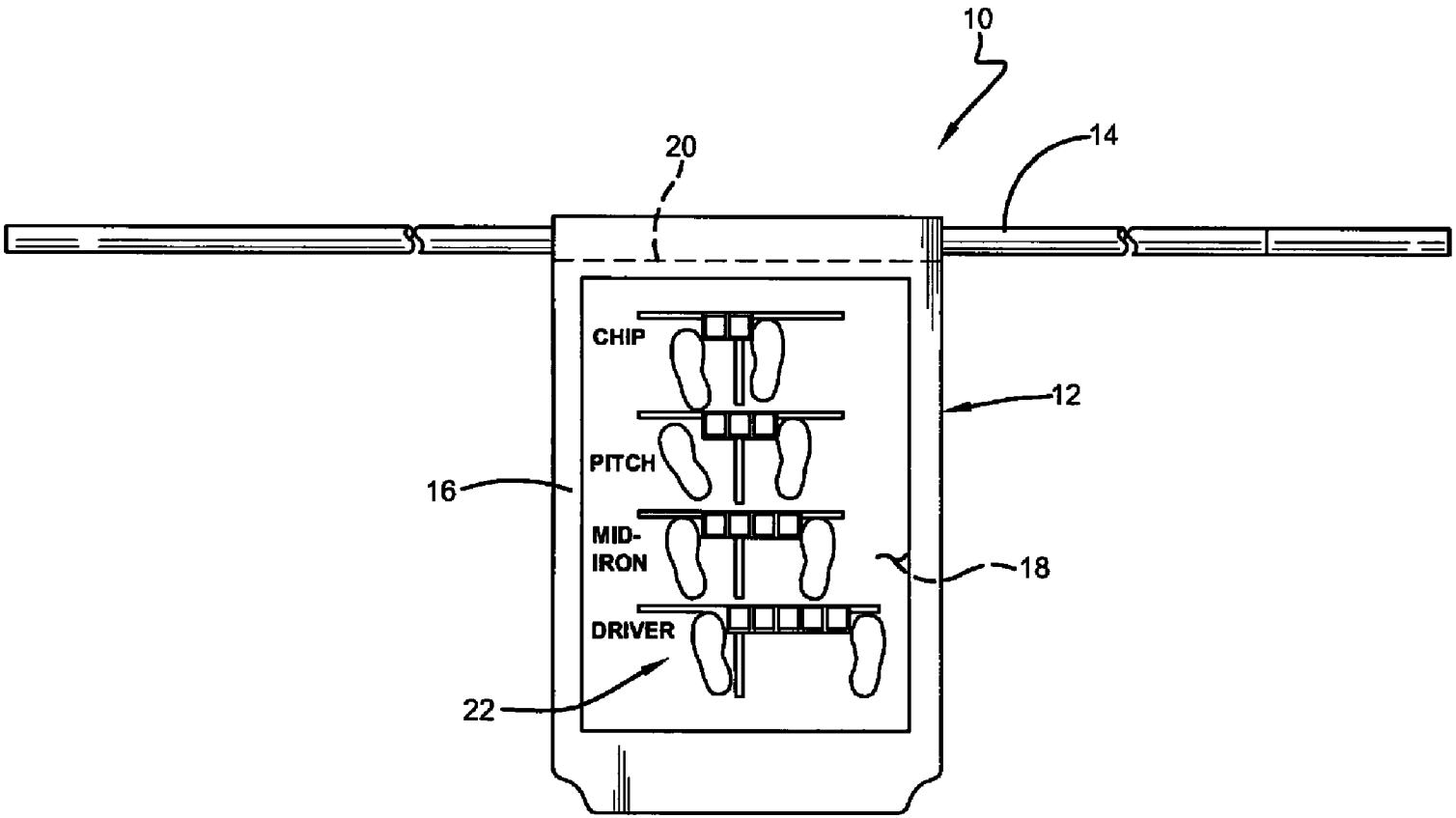
FIG. 2 is an elevational view of the golf instruction apparatus of FIG. 1.

The golf instruction apparatus 10 shown in FIGS. 1 and 2 includes instructional markings 22 that indicate proper ball position relative to a golfer's feet for various golf shots. The ball position instructions use words and pictures to indicate the correct ball position relative to the golfer's feet for several golf shots, including driving, mid-iron shots, pitching, and chipping. The instructional markings 22 are provided on first surface 16 of instruction flag 12, and rod clamp 20 is provided on second surface 18. After securing instruction flag 12 to alignment rod 14, the alignment rod may be positioned on a ground surface so that it is parallel to the desired path T of the golf ball 23. A golfer may then use alignment rod 14 to ensure that they are properly aimed at the target. Instruction flag 12 provides a visual reminder to a golfer to check ball position while practicing a golf swing as a golf instructor might do during golf lessons.

Figure 3:
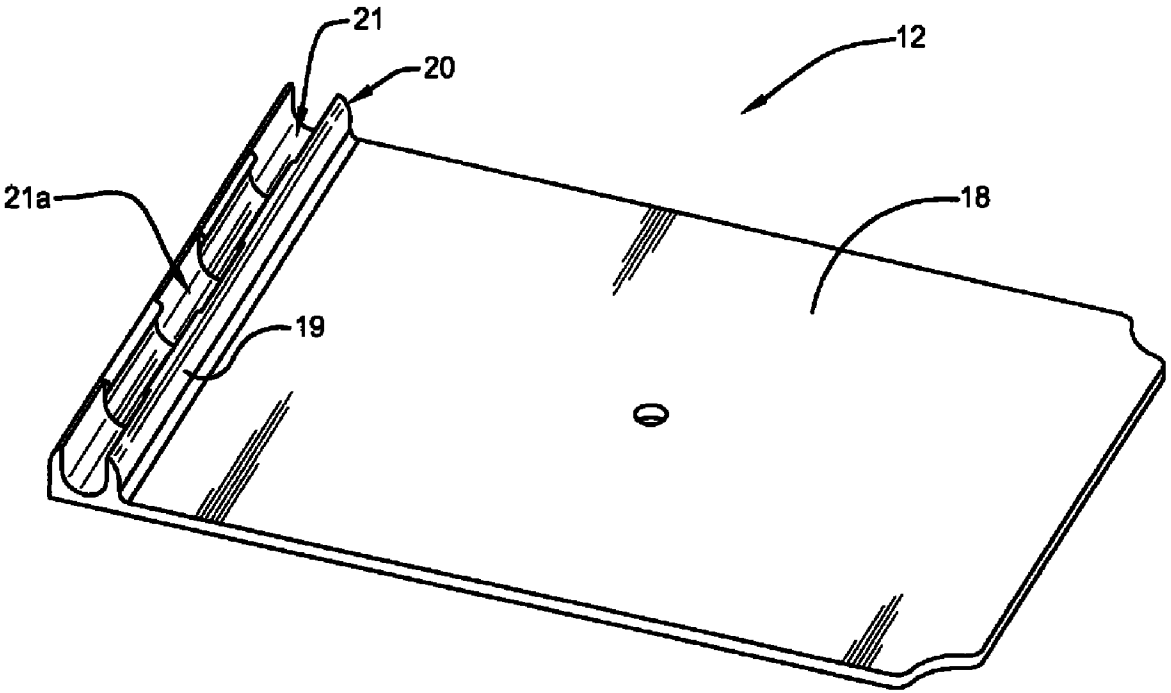
FIG. 3 is a perspective view of an instruction flag according to the concepts of the present invention.

Another golf instruction apparatus 30 according to the concepts of the present invention shown in FIG. 3 includes an alignment rod 32 and an instruction flag 34 removably secured thereto. Instruction flag 34 includes instructional markings 36 that assist in putting practice. Golf instruction apparatus 30 is substantially similar to golf instruction apparatus 10, but is adapted to provide assistance with a putting stroke. The putting instructions include images depicting proper ball position as well as reference lines to help a golfer ensure that the putter face 35 is square to the target line.

Instructional markings 36 and a rod clamp 37 are both provided on a first surface 38 of instruction flag 34. By providing both rod clamp 37 and instructional markings 36 on the same surface, instruction flag 34 may be secured to alignment rod 32 and positioned flush with a ground surface. An edge 39 of instruction flag 34 opposite alignment rod 32 may then be used as a guide that is parallel to alignment rod 32 to assist in putting. Alignment rod 32 may be positioned on a ground surface so that edge 39 is pointed at a target and instructional markings 36 are facing upward toward a golfer. Golf instruction apparatus 30 assists a golfer in obtaining a square club face and in achieving proper alignment and putting stroke while practicing putting.

Figure 4:
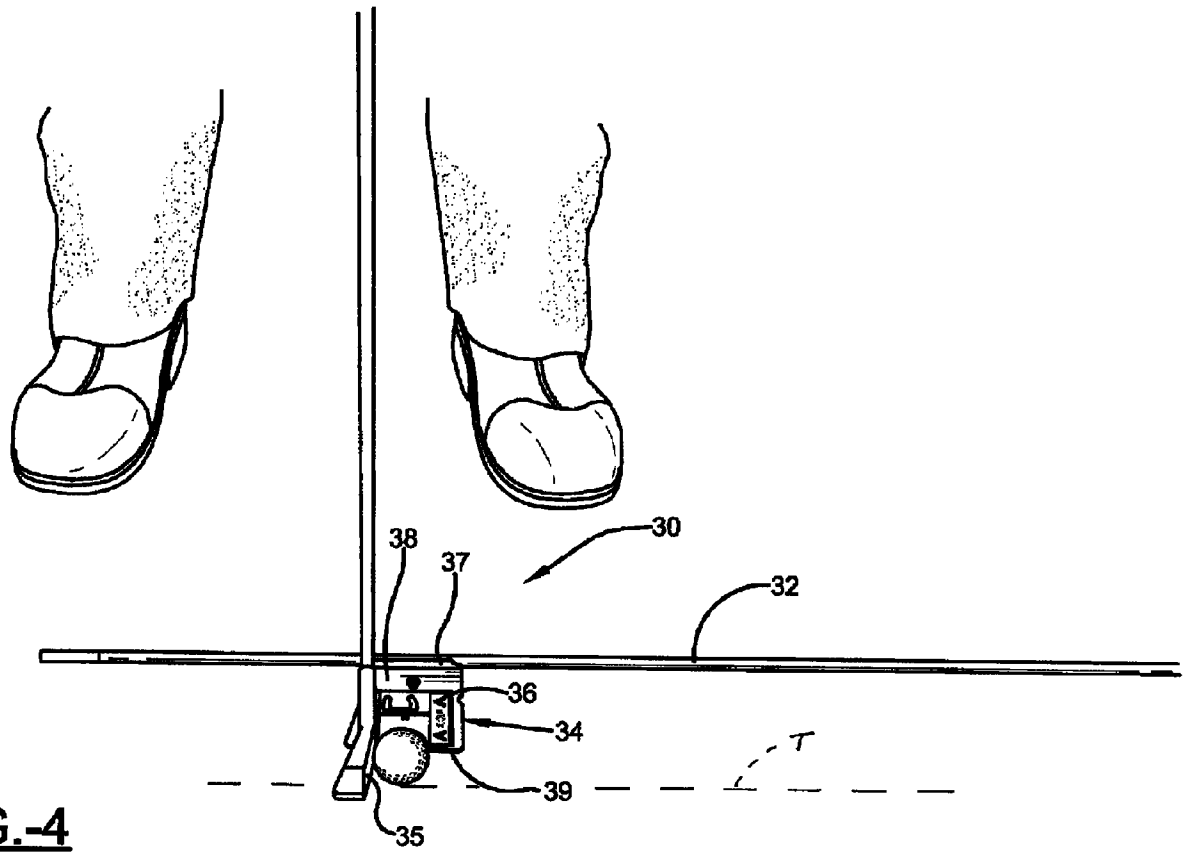
FIG. 4 is a fragmentary perspective view of a golfer using a golf instruction apparatus including putting instructions according to the concepts of the present invention.

Yet another golf instruction apparatus 40 according to the concepts of the present invention is shown in FIG. 4 and includes an alignment rod 42 and an instruction flag 44 removable secured thereto. Golf instruction apparatus 40 is substantially similar to golf instruction apparatus 30, but includes alternative instruction markings. Golf instruction apparatus 40 provides instructional markings 46 that include slots 47 that indicate a square putter face angle relative to the target line, and a slot 48 indicating the target line.

A golf ball 45 may rest on a ground surface adjacent to instruction flag 44 and may be retained in a notch 43 in an edge of the instruction flag. Slots 47 may be used to position a putter 49 square to the target line T and to assist in a proper putting stroke. Instructional markings 46 and a rod clamp 50 are both provided on a first surface 52 of instruction flag 44. The position of instructional markings 46 and rod clamp 50 on the same surface of instruction flag 44 allows instruction flag 44 to be secured to alignment rod 42 and positioned flush with a ground surface. Similar to golf instruction apparatus 30, alignment rod 42 may be positioned on a ground surface so that slot 48 is pointed at a target and instructional markings 46 are facing upward toward a golfer.

Figure 5:
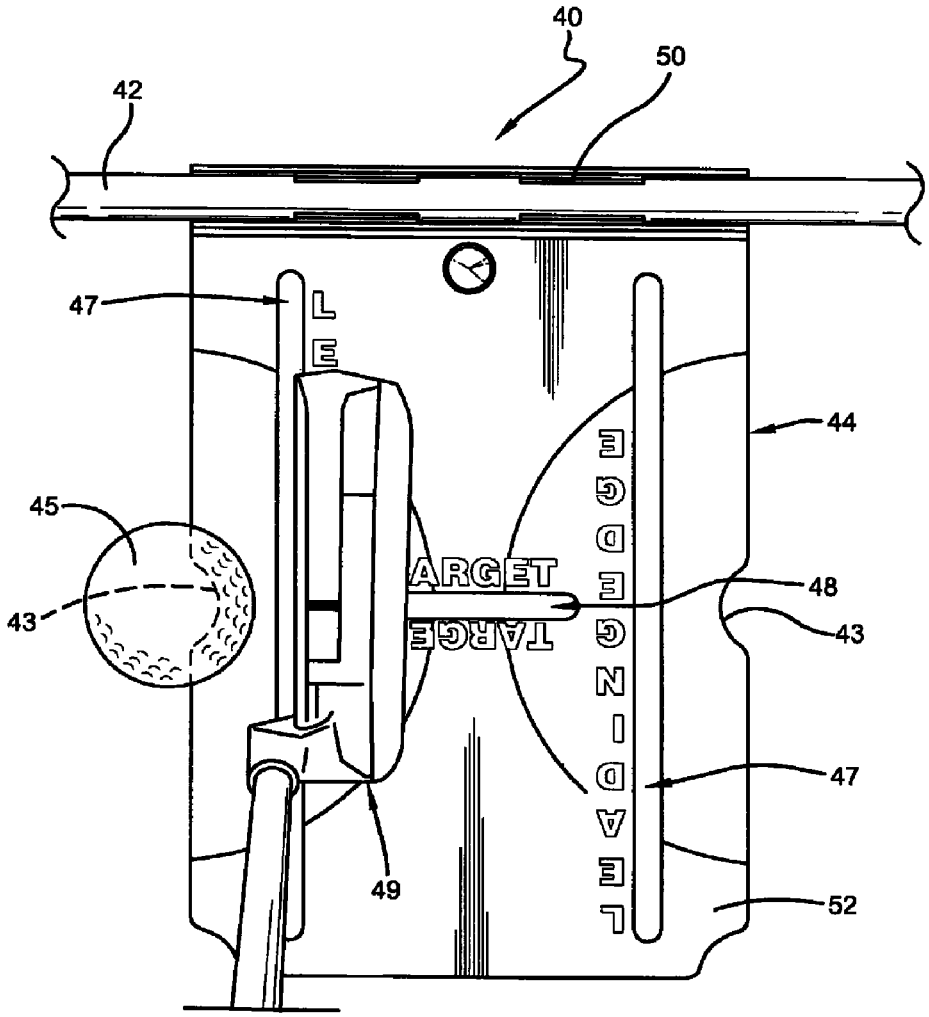
FIG. 5 is a fragmentary perspective view of a golfer using a golf instruction apparatus including slots to provide instruction for a putting stroke according to the concepts of the present invention.
Figure 6:
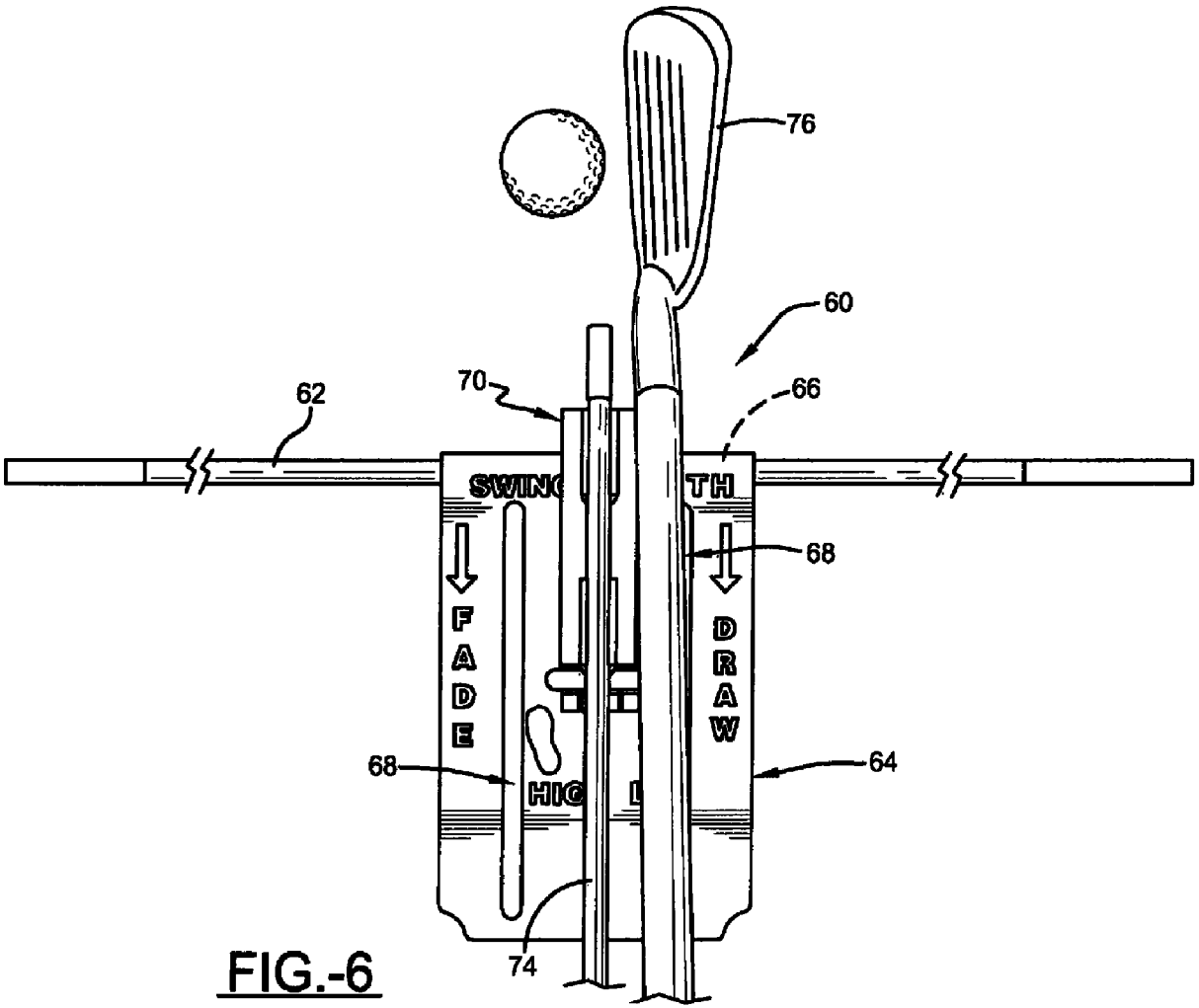
FIG. 6 is a fragmentary perspective view of a golfer using a golf instruction apparatus having a pivotable attachment and a second alignment rod according to the concepts of the present invention.
Figure 7:
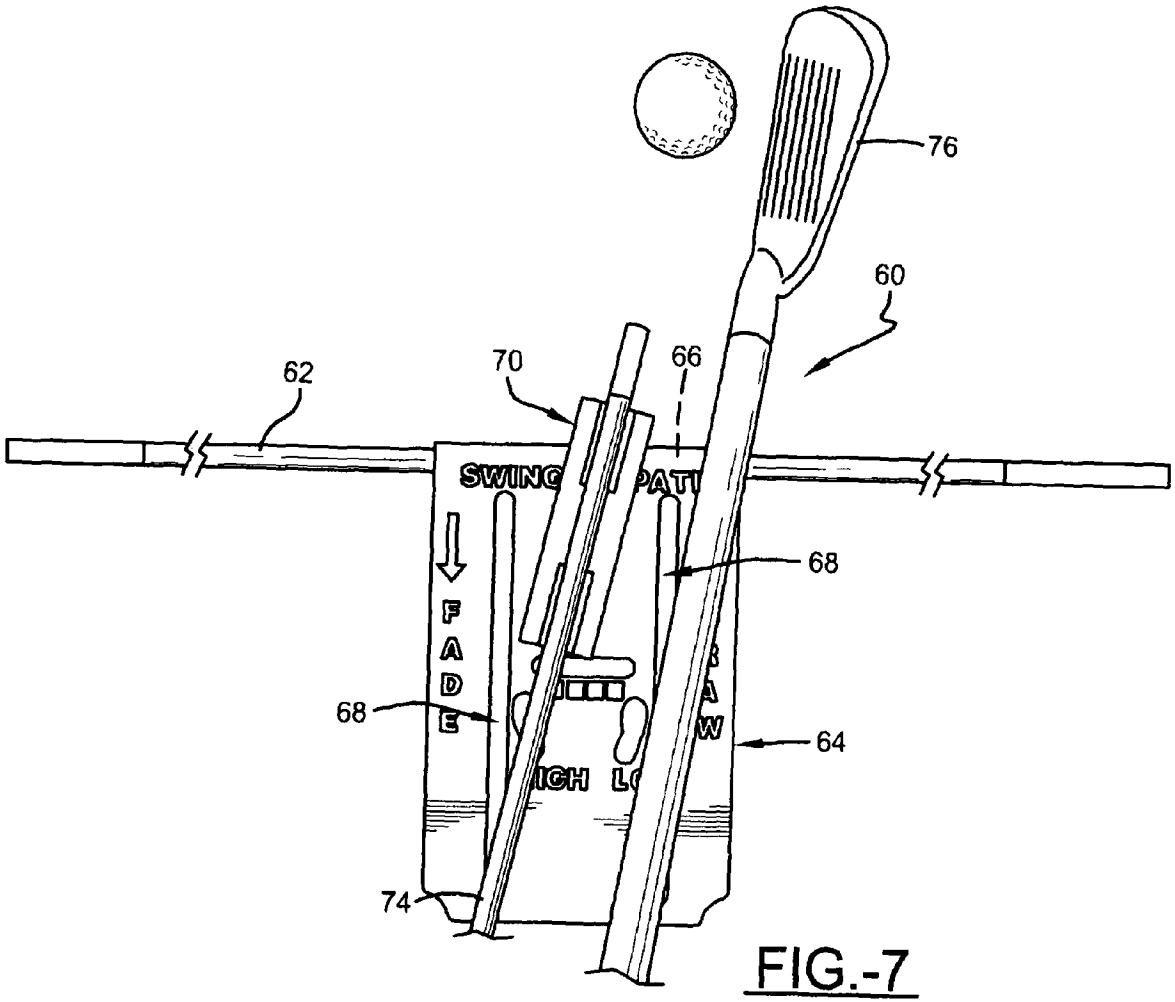
FIG. 7 is a fragmentary perspective view of a golfer using the golf instruction apparatus of FIG. 5 positioned to provide visual cues for hitting a fade shot according to the concepts of the present invention.

Another golf instruction apparatus 60 according to the concepts of the present invention is shown in FIGS. 5 and 6 and includes an alignment rod 62 and an instruction flag 64 removably secured thereto. Instruction flag 64 is secured to alignment rod 62 by a rod clamp 66 positioned along one edge of the instruction flag. Golf instruction apparatus 60 is substantially similar to golf instruction apparatus 10, but is adapted to provide instructions for hitting a fade (ball initially travels left of the target and curves back toward the target for a right handed golfer) or a draw (ball initially travels right of the target and curves back toward the target for a right handed golfer).

The instructional markings 66 provided on instruction flag 64 include slots 68 indicating a square club face angle and a pivoting base member 70. Base member 70 is rotatably secured to instruction flag 64 and includes a C-shaped rod clamp 72 in a top surface thereof. Base member 70 may be rotatably secured to instruction flag 64 by any method or mechanism known to those skilled in the art. A second alignment rod 74 is removably secured in base member 70 by rod clamp 72. Second alignment rod 74 is positioned in base member 70 so that substantially all of the length of the rod extends in one direction and only a small portion of the rod extends in the other direction so as to not impede the golf club head 76 during a golf swing.

Instruction flag 64 is secured to alignment rod 62, and alignment rod 62 is positioned on a ground surface parallel with the golf ball's initial trajectory when a golfer hits a draw or a fade. Base member 70 and second alignment rod 74 are then positioned perpendicular to the target, or, stated differently, perpendicular to a line extending between the ball and a target. The second alignment rod 74 indicates the proper club face angle, which should always be square to the target. Alignment rod 62 indicates the proper club swing path to hit the fade or draw. Golf instruction apparatus 60 thereby provides visual cues to a golfer indicating proper alignment, swing path, and club face angle.

It is thus evident that a method and apparatus of providing golf instruction as described herein accomplishes the objects of the present invention and otherwise substantially improves the art.

What is claimed is:

1. A method comprising the steps of: providing an alignment rod; providing a flag having instructional markings thereon; securing the flag to the alignment rod; positioning the alignment rod and flag on a ground surface so that the instructional markings are facing up; and instructing a golfer using the alignment rod and instructional markings on the flag, wherein the instructional markings on the flag include a base pivotably secured to the flag and a second alignment rod secured in the base, the method further comprising the step of orienting the second alignment rod relative to the alignment rod.

2. A golf instruction apparatus comprising a flag having a first planar surface and a second planar surface, a rod clamp extending from one of said first planar surface and said second planar surface adjacent an edge of the flag, said rod clamp including a pair of flexible arms that provide a generally C shaped cross section to removably attach the flag to an alignment rod, and golf instruction markings on one of said first planar surface and said second planar surface, said golf instruction markings including a slot oriented generally parallel to said rod clamp.

3. The apparatus of claim 2, wherein the flag is generally rigid.

4. The apparatus of claim 2, wherein said flag includes an aperture therethrough to facilitate anchoring of the flag to a ground surface.

* * * * *